United States Patent [19]

Sundman

[11] 4,089,420

[45] May 16, 1978

[54] APPARATUS FOR SORTING BOTTLES AND THE LIKE

[75] Inventor: Gunnar Bernhard Sundman, Helsinki, Finland

[73] Assignee: Oy Hartwall AB, Helsinki, Finland

[21] Appl. No.: 629,784

[22] Filed: Nov. 7, 1975

Related U.S. Application Data

[63] Continuation of Ser. No. 505,990, Sep. 16, 1974, abandoned.

[51] Int. Cl.[2] ..... B07C 9/00

[52] U.S. Cl. ..... 209/80; 209/73

[58] Field of Search ..... 209/73, 74, 80, 88, 209/90; 198/22 B

[56] References Cited

U.S. PATENT DOCUMENTS

| | | | |
|---|---|---|---|
| 3,279,599 | 10/1966 | Drennan | 209/74 |
| 3,327,848 | 6/1967 | Barnhart et al. | 209/74 |
| 3,409,128 | 11/1968 | Hutaff | 209/80 |
| 3,447,679 | 6/1969 | Molins et al. | 209/73 |

*Primary Examiner*—Drayton E. Hoffman
*Assistant Examiner*—Joseph J. Rolla
*Attorney, Agent, or Firm*—Haseltine, Lake & Waters

[57] ABSTRACT

Apparatus for sorting bottles of two or more types. The apparatus comprises a feeding track for unsorted bottles and a number of discharge tracks for the different bottle types and a transporting mechanism in the form of a star wheel. The star wheel is provided with successive bottle pockets each arranged to receive a bottle from the feeding track. Each pocket is provided with a suction cup connected to a vacuum system and corresponding to the contour of one type of bottle for holding such bottle for detachment at a desired later discharge track but leaving the other type of bottle free to travel to a first discharge track.

5 Claims, 5 Drawing Figures

FIG.1
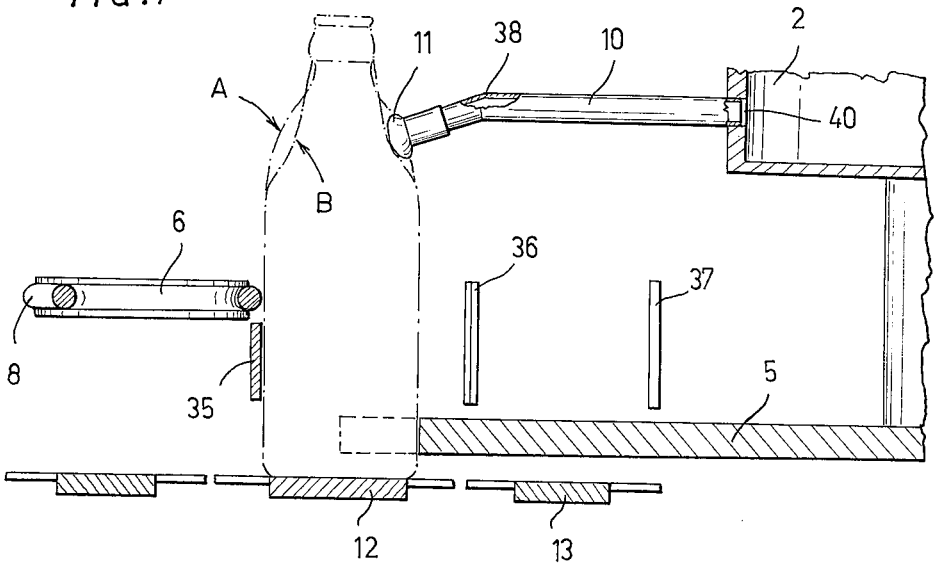
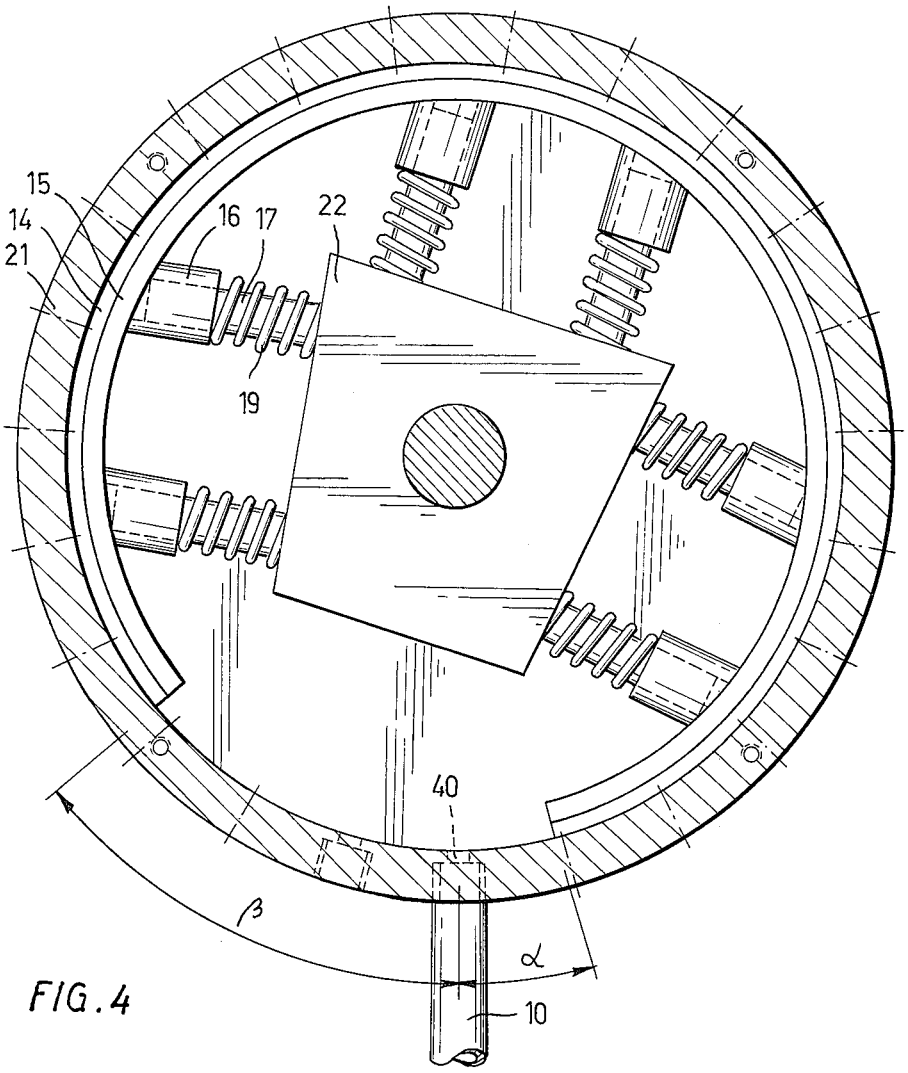
FIG.4

2
5
31
33
34
A1
A2
A3
A4
A5
A6
B1
B2
B3
B4
7
8
6
10
38
12
35
36
37
13
α
β

APPARATUS FOR SORTING BOTTLES AND THE LIKE

CROSS-RELATED APPLICATION

This Application is a continuation of copending application Ser. No. 505,990 filed Sept. 16, 1974, now abandoned.

This invention relates to an apparatus for sorting bottles or the like, of various types, comprising:

— at least one feeding track for unsorted bottles;

— at least one first and one subsequent discharge track for both types of bottles; and — a sorting device connecting the feeding track with the discharge tracks through which the bottles are arranged to pass one by one in arbitrary order, and which comprises a transporting means for transporting the bottles in, for instance, a linear or arc-shaped manner, said transporting means comprisng a number of successive bottle pockets each arranged to take from the feeding track a bottle and from which the assorted bottles are removed by an appropriate means, — at least one suction cup arranged in connection with each bottle pocket and connected with a vacuum system, the suction cup being under the influence of vacuum only over a limited part of the conveyor track.

It is known to sort bottles both manually and by using electromechanical devices. The manual operation demands a large amount of manpower while the electromechanical machines require complex automation resulting in expensive machines sensitive to disturbances.

The object of the present invention is to remove the above defects and is mainly characterized in that — each suction cup has been formed and placed in the bottle pocket so that it corresponds to the contour of one type of bottle which is to be held by the suction cup, but leaves the other types of bottles untouched, and — each bottle which has been suctioned is arranged, by aid of means for disengagement of the vacuum, to be detached at a desired later discharge track, while the bottles not influenced by any suction cup after having passed through the sorting device, are arranged to end up directly in said first discharge track.

The apparatus is simple and, therefore, inexpensive. Since the operation does not require automation, the machine is reliable. The machine requires no operating personnel, the need for service is minimal.

The invention will be described in greater detail by means of embodiments as shown in the appended drawings.

FIG. 1 shows schematically how a suction cup attaches itself to one of the two different bottle contours.

FIG. 4 shows on enlarged scale and in cross section the vacuum pocket in the apparatus of FIGS. 2 and 3.

The operation of the apparatus can be divided into four phases as follows:

— feeding of the bottles into the sorting apparatus,

— centering of the bottles against the suction cups,

— sorting of bottles with a certain contour,

— division of bottles on different tracks.

The feeding of the bottles into the sorting apparatus takes place by means of a track 33, 34 driven by lamelled chains 12, 13 where the bottles A, B are to be quite close to each other. This implies that the speed of the bottle track is somewhat greater than the speed of the sorting apparatus. This implies in addition that the apparatus is stopped if the flow of bottles is discontinued. Stop and start is effected with a limit-switch (not shown) placed about 2 meters before the device. As long as the limit-switch is influenced by the bottles A, B, the machine is running, but when the limit-switch is free of bottles, the machine is stopped.

Figure 2:
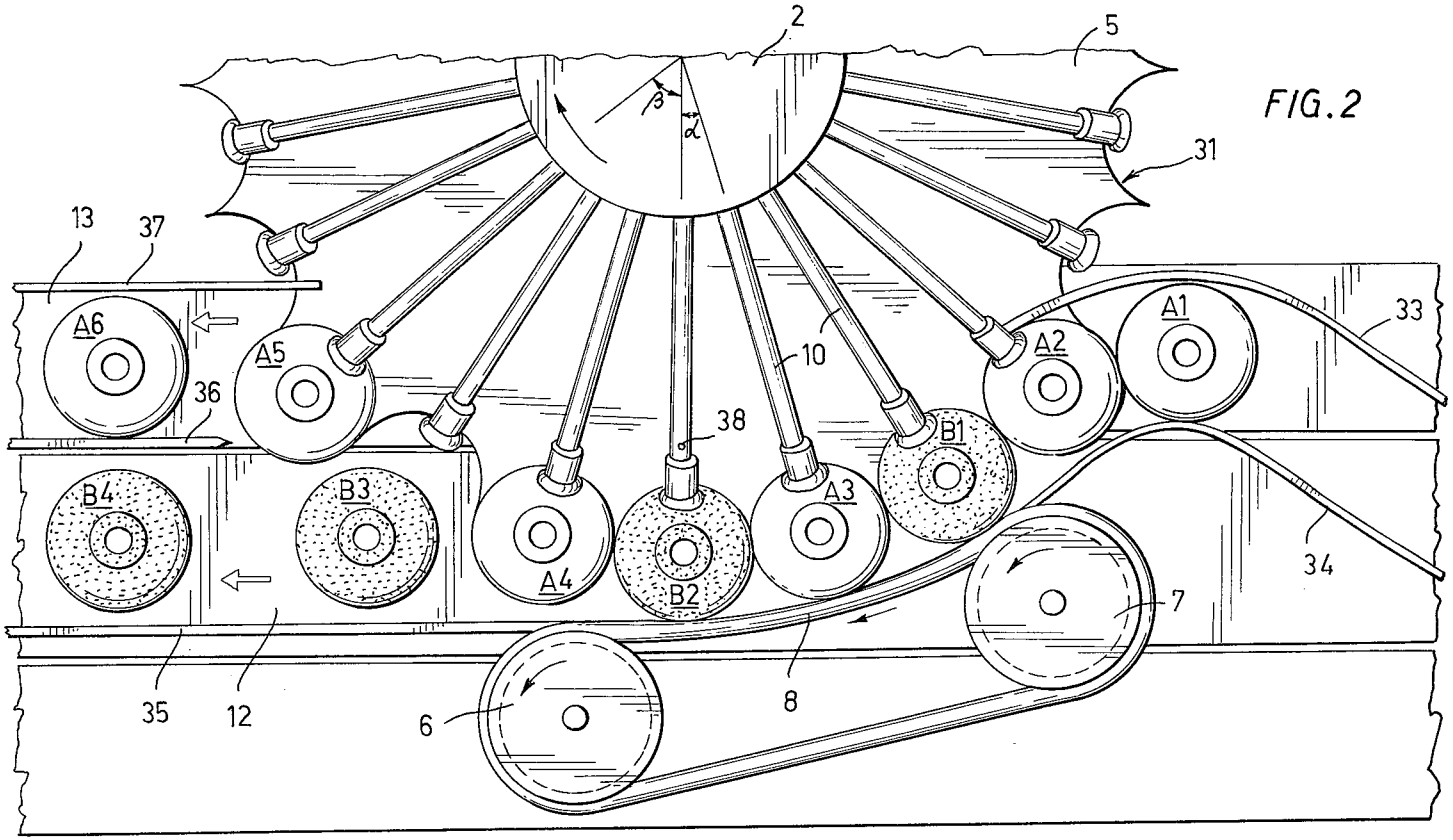
FIG. 2 shows in operation a sorting apparatus in accordance with the invention in top plan view and with the upper star wheel of the wheel portion detached.
Figure 3:
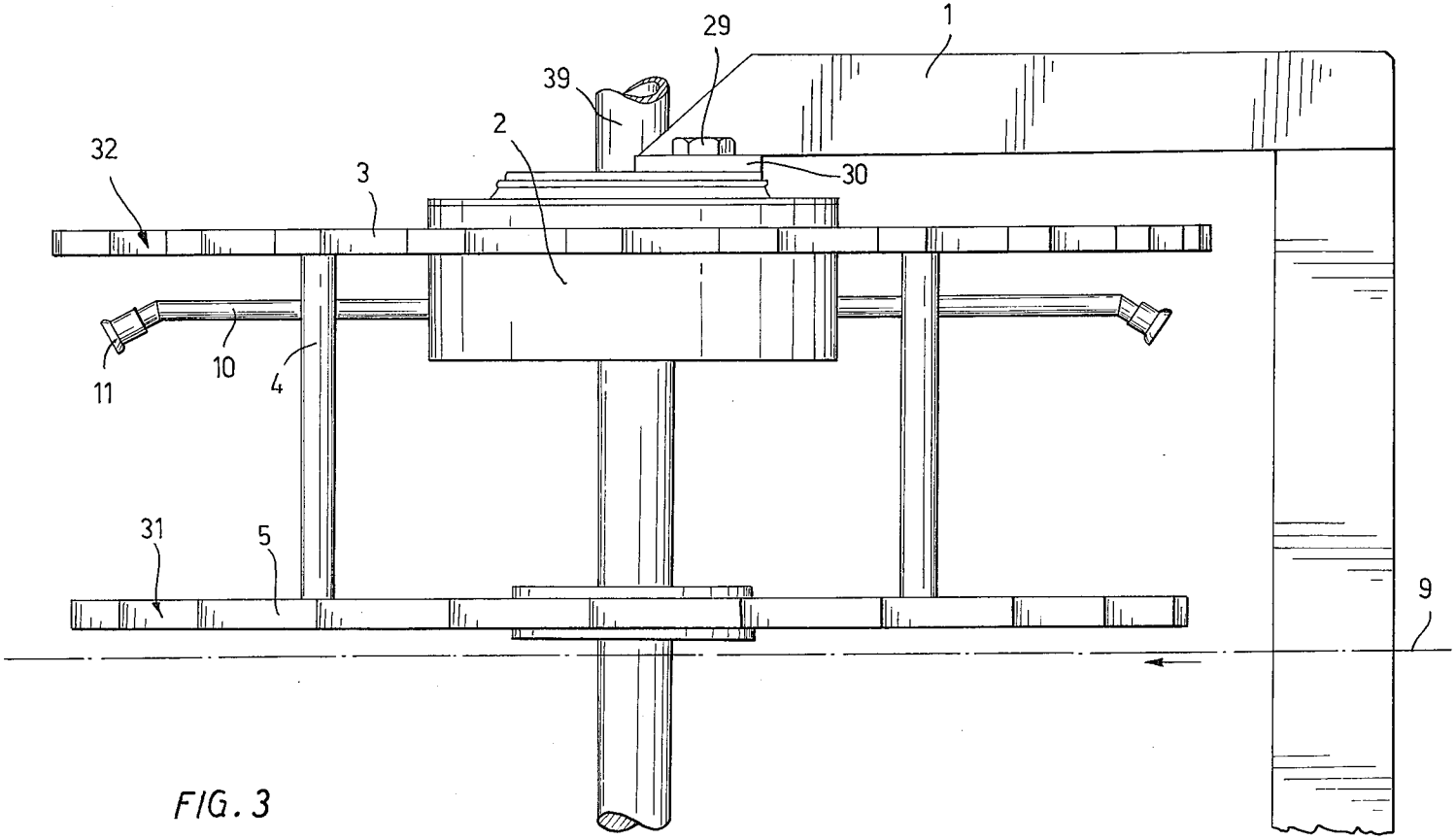
FIG. 3 shows the sorting apparatus of FIG. 2 in side view.

As appears from the FIGS. 2 and 3, bottle pockets consist of two preferably circular arcuate peripheral cavities 31, 32, arranged on mutually spaced, coaxially arranged star wheels, which cavities correspond to the cross section of the body portion as well as to the neck portion of the bottles.

The function of both star wheels 3 and 5 is to center the bottles against the suction cups 11. The "bottle pockets" of the star wheels are shaped in accordance with the diameters of the bottles, the upper star wheel 3 being adjusted to the neck portion of the bottles.

When the bottles A, B arrive in a close line at the star wheel 3, 5, one bottle A or B is distributed to each bottle pocket 31, 32 in the star wheels. In order to make the centering exact, an endless spring belt 8 presses the bottles against the star wheels. The endless spring belt 8 runs with the bottles which pass through the machine, over turning wheels 6, 7 at both ends (FIG. 2).

The sorting of bottles with a specific contour takes place with suction cups 11 connected to a vacuum chamber 2. The vacuum chamber 2 is connected via a pipe 39 to a vacuum pump (not shown on the drawing). The vacuum pump is continuously driven in operation and maintains a constant vacuum in the vacuum chamber 2. Bottles with two different contours are passed through the apparatus. The suction cups 11 are located to fit the bottle contour A and apply suction to the bottle while the other type of bottle B is left free (FIG. 1). The suction cups 11 are moreover located in the center of each bottle pocket 31, 32 in the star wheels 3, 5. The vacuum is applied to the suction cups at an angle $\alpha$ of 15° before the center line which extends 90° to the running direction of the bottles A, B through the sorting apparatus. The vacuum is disconnected from the suction cups at an angle $\beta$ of 50.5° after the center line in question. The sector under which the vacuum is applied is limited by a slide rail 14, 15 which covers the holes 40 of all the other suction cups 11 except those being within said sector $\alpha + \beta$ of 65.5°. The slide rail 14, 15 is pressed against the wall of the vacuum chamber 2 to which the suction cups 11 are connected via the tubes 10 by means of six compression springs 19 (FIG. 4). When the suction tube 10 with suction cups 11 has reached the position where the slide rail 14, 15 covers the hole 40 of the vacuum chamber 2, the vacuum is disconnected. In order to avoid that the vacuum in the suction tube 10 continues to hold the bottle A attached to the suction cup 11, there is a boring 38 of $\phi$ 0.5 mm drilled in the suction tube through which boring the suction tube 10 is supplied with air and the vacuum is removed to release the bottle A.

In front of the sorting apparatus, the bottles are in a row which is conducted into the star wheels 3, 5. In the apparatus, each bottle of type A is suctioned by the suction cups 11, each bottle of type B only passing the apparatus through the star wheel 3, 5 and proceeding straight ahead as soon as it is detached from the spring belt and the star wheel 3, 5. The bottle of type A which is suctioned by the suction cups 11 travels with the rotating star wheel 3, 5 to the point where the vacuum is disconnected. In this way, the different bottles A, B are released at different spots and are discharged on respective bottle conveyors 12, 13 which are placed after the sorting apparatus and separated by a rail 36 therebetween.

Figure 5:
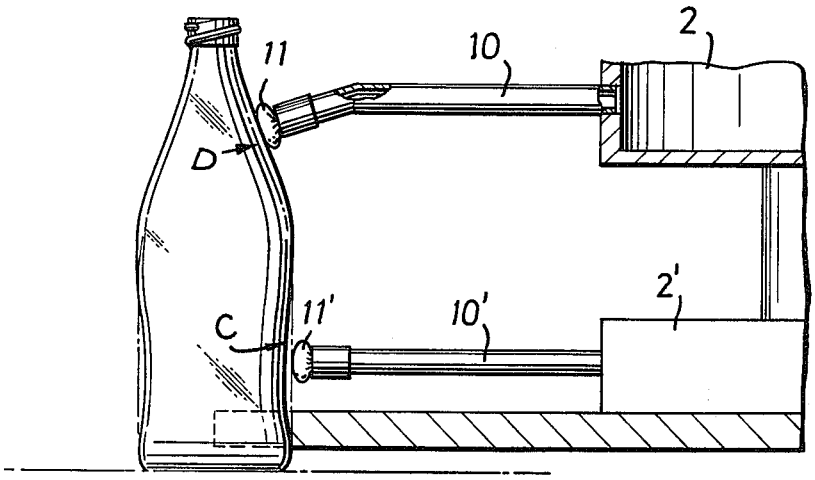
FIG. 5 is a diagrammatic view showing a portion of a modified apparatus for operating on several different bottle types.

The description presupposes the aforesaid apparatus assorts only two different types of bottles, i.e., that each suction cup is connected to one vacuum chamber. If necessary, it is possible to sort with the same apparatus several types of bottle as shown in FIG. 5 by placing two vacuum chambers 2 and 2$^1$ with corresponding suction tubes 10 and 10$^1$ and suction cups 11 and 11$_1$ one on top of another. Consequently, for example, each bottle pocket 31, 32 can be equipped with two suction cups 11, 11$^1$ intended for different bottle contours at D and C in which case also two vacuum chambers 2 and 2$^1$ are provided. As in evident, the two suction cups acting on each bottle can selectively operate to respectively discharge the bottles into one of several discharge tracks. The position of the suction cups will be adapted to the type of bottle to be sorted and the place where the bottles will be discharged is determined in accordance with the sector under which the vacuum is applied. According to measurements, the adequate size of this sector is 60° to 70° and the sector begins at a point which is suitably situated 10° to 20° before the center line which is at right angles to the flow direction of the bottles through the sorting apparatus. Naturally it is also possible to sort other articles than bottles according to the same principle, for example jars, containers, etc.

The sorting apparatus itself need not, of course, comprise a wheel member, but the bottle pockets can also be arranged on the periphery of an endless transport chain or the like giving the bottles a linear or an arcuate movement. The discharge can also take place on several levels and/or by using flap doors for one or several kinds of bottles.

What I claim is:

1. Apparatus for sorting bottles of at least two types, whose difference resides at least in the contour of one portion of the bottles, comprising at least one feeding track for unsorted bottles; at least one discharge track for each type of bottle; and a sorting device connecting the feeding track with the discharge tracks through which the bottles are arranged to pass one by one in arbitrary order, and which comprises a transporting means for transporting the bottles along a given path, said transporting means comprising a number of successive bottle pockets each arranged to take one bottle from the feeding track and from which the sorted bottles are removed, a vacuum system, at least one suction cup arranged in connection with each bottle pocket and connected with said vacuum system, means subjecting the suction cups to the influence of vacuum only over a limited part of the conveyor track, each suction cup being formed and placed in the bottle pocket so that it corresponds to the contour of one type of bottle which is to be held by the suction cup, but leaves any other type of bottle untouched, said one type of bottle having a non-cylindrical portion, each bottle which has been suctioned by a cup being released by disengagement of the vacuum at a desired later discharge track, while the bottles not influenced by any suction cup, after having passed through the sorting device, are arranged to end up directly in a first discharge track, said transporting means comprising a rotatable wheel member, the vacuum system comprising at least one vacuum chamber rotating with the wheel member for a plurality of suction cups, and radially directed tubes connecting said at least one vacuum chamber with its corresponding suction cups, said at least one vacuum chamber being cylindrical and including a non-rotating arc-shaped slide rail for connecting and disconnecting the vacuum chamber with the respective suction cups, an endless belt positioned to engage and center bottles in the pockets as the bottles are being selectively suctioned by the suction cups, said radially directed tubes being carried adjacent the pockets with the suction cups on free ends of said tubes, said tubes being so positioned that the suction cups thereon come into contact with said at least one portion of one configuration of bottle while the configuration of said at least one portion of the other bottles does not come into contact with the suction cups and are not influenced thereby.

2. Apparatus as claimed in claim 1 wherein a single vacuum chamber is provided.

3. Apparatus as claimed in claim 1 wherein the number of vacuum chambers is two.

4. Apparatus as claimed in claim 1 wherein each tube is provided with a bore for reinstatement of atmospheric pressure upon disconnecting the associated cup from the vacuum chamber.

5. Apparatus as claimed in claim 1 wherein said discharge tracks extend adjacent one another and travel in the same direction.

* * * * *